US008528214B2

(12) United States Patent
Coffin

(10) Patent No.: US 8,528,214 B2
(45) Date of Patent: Sep. 10, 2013

(54) RAZOR BLADE AND SUPPORT ASSEMBLY

(75) Inventor: David C Coffin, Hamden, CT (US)

(73) Assignee: Eveready Battery Company, Inc., St. Louis, MO (US)

( * ) Notice: Subject to any disclaimer, the term of this patent is extended or adjusted under 35 U.S.C. 154(b) by 118 days.

(21) Appl. No.: 12/785,807

(22) Filed: May 24, 2010

(65) Prior Publication Data

US 2010/0229398 A1 Sep. 16, 2010

Related U.S. Application Data

(63) Continuation of application No. 11/123,643, filed on May 6, 2005, now Pat. No. 7,748,121.

(51) Int. Cl.
*B26B 21/00* (2006.01)

(52) U.S. Cl.
USPC ..... 30/47; 30/49; 30/50

(58) Field of Classification Search
USPC ..... 30/47, 49, 50
See application file for complete search history.

(56) References Cited

U.S. PATENT DOCUMENTS

| | | | | |
|---|---|---|---|---|
| 3,587,171 | A | 6/1971 | Perry | |
| 4,069,580 | A | 1/1978 | Cartwright et al. | |
| 4,324,041 | A * | 4/1982 | Trotta | 30/47 |
| 4,337,575 | A * | 7/1982 | Trotta | 30/47 |
| 4,403,412 | A * | 9/1983 | Trotta | 30/47 |
| 4,443,939 | A | 4/1984 | Motta et al. | |
| 4,516,320 | A | 5/1985 | Peleckis | |
| 4,586,255 | A | 5/1986 | Jacobson | |
| 5,003,694 | A | 4/1991 | Chen | |
| 5,031,316 | A | 7/1991 | Oldroyd | |
| 5,185,927 | A | 2/1993 | Rivers | |
| 5,222,300 | A | 6/1993 | Althaus et al. | |
| 5,251,376 | A | 10/1993 | Althaus et al. | |
| 5,253,420 | A | 10/1993 | Althaus et al. | |
| 5,365,665 | A | 11/1994 | Coffin | |
| 5,388,332 | A | 2/1995 | Oldroyd | |
| 5,410,810 | A | 5/1995 | Gillibrand | |
| 5,557,851 | A | 9/1996 | Ortiz | |
| 5,666,729 | A | 9/1997 | Ferraro | |
| 5,794,343 | A | 8/1998 | Lee et al. | |
| 6,009,624 | A * | 1/2000 | Apprille et al. | 30/50 |
| 6,182,366 | B1 | 2/2001 | Richard | |
| 6,295,734 | B1 | 10/2001 | Gilder et al. | |
| 6,772,523 | B1 | 8/2004 | Richard et al. | |
| 7,197,825 | B2 | 4/2007 | Walker et al. | |
| 7,748,121 | B2 * | 7/2010 | Coffin | 30/47 |

(Continued)

FOREIGN PATENT DOCUMENTS

| | | | |
|---|---|---|---|
| EP | 858869 | A | 8/1998 |
| EP | 1236547 | A | 4/2002 |
| EP | 2375067 | A | 6/2002 |
| WO | WO97/35693 | | 10/1997 |

OTHER PUBLICATIONS

International Search Report dated May 2, 2006, for PCT/US2006/016982.

*Primary Examiner* — Maurina Rachuba
(74) *Attorney, Agent, or Firm* — Energizer Personal Care, LLC

(57) ABSTRACT

A razor blade and support assembly is provided which flexes in response to shaving forces near slots in the blade support. A razor cartridge includes one or more of the aforementioned razor blade and support assemblies positioned in a housing. The razor cartridge may be permanently or removably coupled to a handle to provide a shaving razor.

12 Claims, 9 Drawing Sheets

(56) References Cited

U.S. PATENT DOCUMENTS

2002/0116822 A1 8/2002 Coffin
2002/0144404 A1* 10/2002 Gilder et al. ..... 30/50
2003/0159291 A1 8/2003 Clark
2004/0060176 A1* 4/2004 Gilder et al. ..... 30/50

* cited by examiner

RAZOR BLADE AND SUPPORT ASSEMBLY

CROSS REFERENCE TO RELATED APPLICATIONS

This application is a continuation of application Ser. No. 11/123,643, filed May 6, 2005, the entire contents of which are incorporated by reference herein.

BACKGROUND OF THE INVENTION

1. Field of the Invention

The present invention relates to shaving razors in general and, more particularly, to razor cartridges having razor blade and support assemblies positioned in a housing.

2. Background of the Invention

Modern shaving razors include one or more blades disposed within a housing that is coupled to a handle. The housing and the blade or blades is referred to as a razor cartridge. Some shaving razors have a disposable razor cartridge that is releasably coupled to a reusable handle while others have a handle and a razor cartridge that are intended to be permanently coupled and disposed of as a single unit.

In recognition of the fact that surfaces to be shaved are not perfectly planar, razor cartridges have been designed to compensate for this during shaving. Commercially successful solutions fall into two broad groups. In a first group, the entire housing and the blades are designed to flex along their length during use. Notable examples of this are disclosed in U.S. Pat. Nos. 5,003,694 (to Chen), 6,182,366 (to Richard) and 6,772,523 (to Richard et al.). In a second group, the blades themselves, mounted to rigid supports, are permitted to move within the rigid cartridge housing away from the surface being shaved. In one sub-class the blades may move independently of each other, notable examples being disclosed in several patents to Jacobson, for example U.S. Pat. No. 4,586,255. An example of a blade attached to a rigid support from the Jacobson art is shown in FIGS. 1 & 2. The blade and the support are labeled as such. These drawings are shown to demonstrate that the support for the razor blade is substantially rigid along its length. In a second subclass the entire set of blades is permitted to move as a group within the rigid cartridge housing away from the surface being shaved by movement of the rigid support in relation to the housing. Notable examples of this second sub-class are the disclosed in U.S. Pat. Nos. 5,253,420 and 5,251,376, both to Althaus et al.

Currently, the state of the art for commercially successful devices is to provide a razor cartridge including three or more blades mounted within the housing. In the first group, noted above, with an increasing number of blades, plus obligatory mounting structure for the blades, the cartridge becomes less able to flex during use. Further, to maintain critical dimensional relationships between the skin contacting parts of the housing and the cutting edges of the blades it is desirable that the razor cartridge flexes only about a single plane. As the number of blades within the housing increases, the front to back dimension of the housing increases, that is, the dimension in the direction of travel of the razor cartridge. Thus, while the flexing of this razor cartridge may help it conform to lengthwise irregularities of the surface being shaved, it cannot conform to front to back irregularities. In the second group, the blade or blades are attached to a rigid support such that the supported blade or blades are substantially inflexible along their length and consequently their edges are maintained substantially straight. This second group's ability for its blade or blades to conform to a non-planar surface is limited to one end (defined lengthwise along the razor cartridge) of the blade or blades moving relatively more than the second end of that blade within the housing. The Jacobson devices disclosed in '255 etc have their blade and support assemblies independently spring mounted relative to each other and are therefore are able to conform to front to back irregularities of the surface being shaved. However, these devices have limited conformance to lengthwise irregularities in the surface being shaved as previously described.

Therefore, there is a need in the art to provide a razor blade and support assembly for use in a razor cartridge that can better conform to lengthwise as well as front to back irregularities in the surface being shaved.

SUMMARY

The razor blade and support assembly of the present invention comprises a razor blade having a lower surface and a cutting edge and a blade support having an upper portion and a lower portion. The upper portion of the blade support is attached to the lower surface of the razor blade. The lower portion of the blade support has one or more slots configured such that the razor blade and support assembly can flex near the slot. At least one slot may extend into the upper portion of the blade support. The blade support may further include a stop surface. The blade support is preferably made from stainless steel or a molded thermoplastic. The slot may be bridged by a material having a lower elastic modulus than the material of the blade support, such as thermoplastic elastomer.

In a further embodiment, the present invention comprises a razor blade that defines a length and that has a lower surface and a cutting edge and two or more blade supports. Each blade support has an upper portion and a lower portion. The upper portion of each blade support is attached to the lower surface of the razor blade and the blade supports are spaced apart lengthwise along the lower surface of the razor blade. The razor blade and support assembly can flex by means of the portion of the razor blade between adjacent blade supports flexing. A web of a second material having a lower elastic modulus than the blade support, such as thermoplastic elastomer, may bridge the gap between adjacent blade supports.

In a further embodiment of the present invention, a housing for a razor cartridge is provided. The housing has a guard at the front of the housing, a cap at the rear of the housing and a blade mounting region between the guard and the cap. The housing has two end walls connecting the guard and the cap. The housing also has one or more restraining surfaces. At least one razor blade and support assembly as previously described is positioned in the blade mounting region. The restraining surface of the housing acts to restrict the flexural deflection of the razor blade and support assembly in a direction out of the housing.

In a further embodiment of the present invention, a razor cartridge is provided. The razor cartridge comprises a housing and one or more razor blade and support assemblies as previously described. The lower portion of the blade support or supports is provided with a stop surface. The stop surface can abut or be closely spaced from a restraining surface of the housing. The stop and restraining surfaces are so configured to permit the razor blade and support assembly to flex in a first direction into the housing. In one aspect these two surfaces abut each other and prevent any flexural deflection of the razor blade and support assembly in a second direction out of the housing. In a second aspect, a gap may be provided between these two surfaces. This will restrict the flexural deflection of the razor blade and support assembly in the second direction out of the housing to a small value, preferably less than 0.2 mm. The flexural deflection in this second direction may provide a more aggressive shave in a controlled manner for a user who might prefer this. In a third aspect, a further limit surface is provided to limit the maximum flexural deflection of the razor blade and support assembly in the first direction. The limit surface may be configured whereby the forwardmost razor blade and support assembly may have a greater deflection in the first direction than any other razor blade and support assembly.

In a further embodiment of the present invention, a shaving razor is provided. The shaving razor comprises a razor cartridge as described above coupled to a handle.

The above features and advantages of the present invention will be more fully understood with reference to the following detailed description when taken in conjunction with the accompanying drawings.

DETAILED DESCRIPTION

DESCRIPTION

Figure 14:
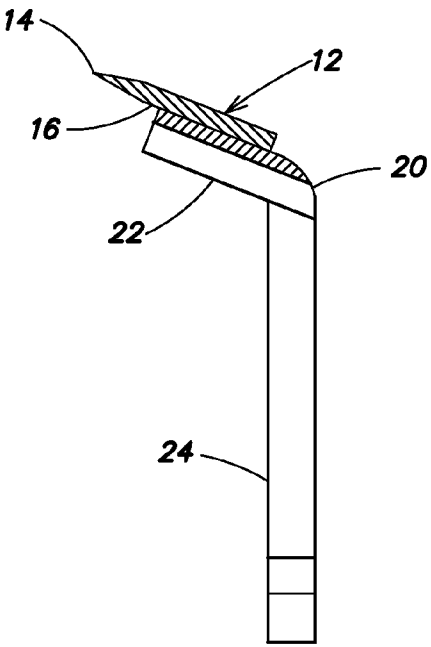
FIG. 14 is a sectional view along line 14-14 of FIG. 13.
Figure 13:
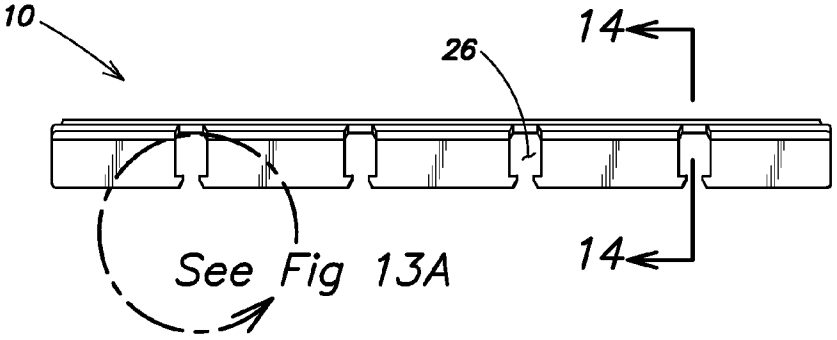
FIG. 13 is a front view of the preferred embodiment of the present invention.
Figure 13A:
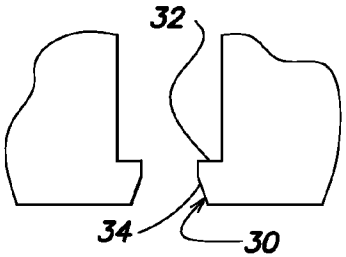
FIG. 13A is a detailed view of FIG. 13.

Referring now to the drawings and in particular to FIGS. 13, 13A and 14, a razor blade and support assembly 10 is shown which comprises a razor blade 12 having a cutting edge 14 and a lower surface 16 and a blade support 20. The razor blade is preferably made from stainless steel, however other materials, such as ceramic or single crystal materials, are within the scope of this invention. The razor blade is typically 0.05-0.15 mm thick. One of skill in the art will recognize this as being readily flexible. The blade support comprises an upper portion 22 and a lower portion 24. The blade support is preferably made from stainless steel, however other materials, such as thermoplastics or ceramics, are within the scope of this invention. The lower surface of the razor blade is attached to the upper portion of the support, preferably by laser welding. Other attachment methods, such as: resistance spot welding; use of an adhesive or use of an interlaying adhesive coated membrane, as is known as double-faced or double-sided tape are within the scope of this invention. The lower portion of the blade support has one or more slots 26 that extend into the upper portion to locally reduce the thickness of the upper portion. The slots are preferably 0.5 to 5 mm wide and more preferably 1 to 2 mm wide. The thinnest part of the reduced thickness part of the upper portion is preferably 0.025-0.15 mm thick. The blade support as described can readily be manufactured by perforation, coining and forming or by injection molding or by other suitable process. At least one slot has a projection 30 on one face of the slot, the projection having an upper stop surface 32 and a lead-in surface 34 to facilitate assembly of the razor blade and support assembly into a housing.

Figure 1:
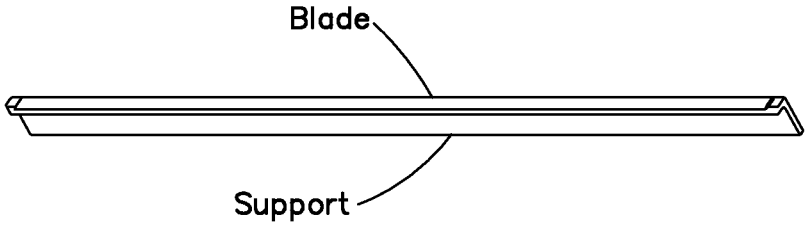
FIG. 1 (Prior Art)
FIG. 1 is an isometric view from the top of the rigidly supported blade of the prior art.
Figure 2:
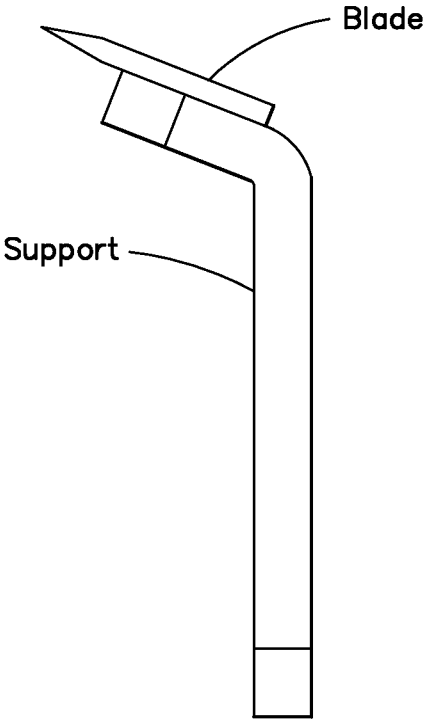
FIG. 2 (Prior Art)
FIG. 2 is an end view of the rigidly supported blade of the prior art.
Figure 4:
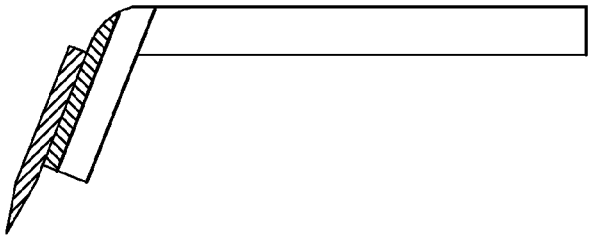
FIG. 4 is a sectional view along line 4-4 of FIG. 3.
Figure 3:
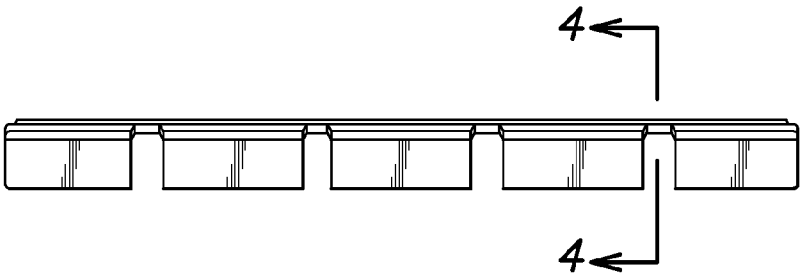
FIG. 3 is a front view of one embodiment of the present invention.
Figure 5:
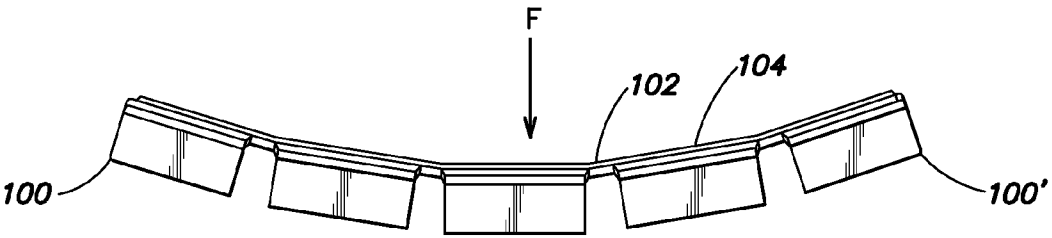
FIG. 5 is a front view of one embodiment of the present invention in an exaggerated flexed position.

Referring now to FIGS. 3-5, these show a simplified version of the preceding embodiment and are intended to demonstrate the flexing mode of the razor blade and support assembly. In particular, FIG. 5 shows the razor blade and support assembly in an exaggerated flexurally deflected position. The razor blade and support assembly is supported at positions 100 and 100' and has a reaction force from shaving a surface applied in an approximate direction F. The distribution of force F along the length of the razor blade and support assembly is not critical to the practice of this invention. In these circumstances the razor blade and support assembly will flex only near the slot, as in position 102, and will remain substantially straight between adjacent slots, as in position 104. One of skill in the art will realize that the razor blade and support assembly will return to the undeflected position as shown in FIG. 3 when the shaving load F is removed providing the flexural deflection is within the elastic range of the razor blade and support assembly. One of skill in the art will also realize that a maximum flexural deflection of about 0.3 mm under normal shaving loads will be sufficient for the razor blade and support assembly to react to irregularities in the surface being shaved.

Figure 15:
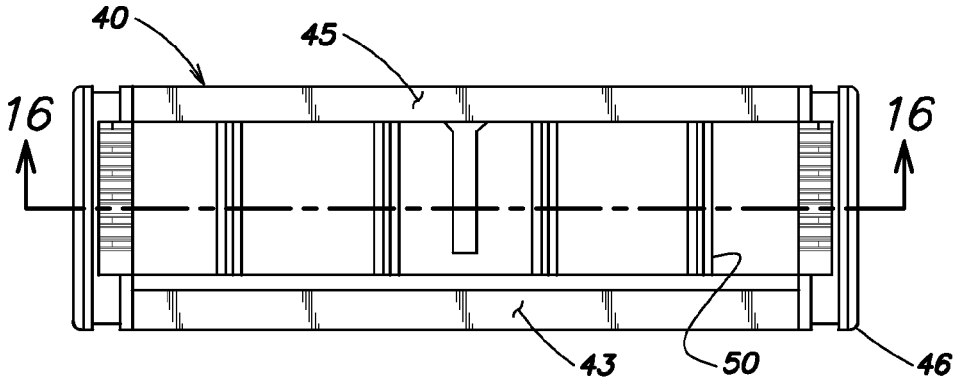
FIG. 15 is a top plan view of the housing of the present invention.
Figure 16:
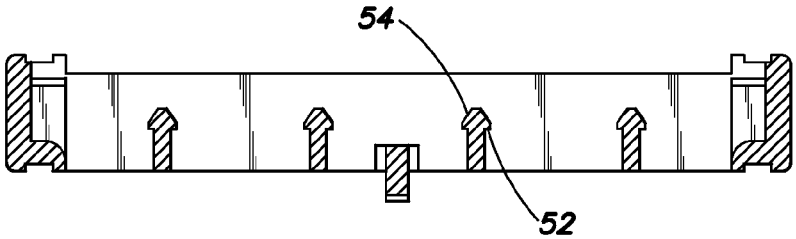
FIG. 16 is a sectional view along line 16-16 of FIG. 15.
Figure 17:
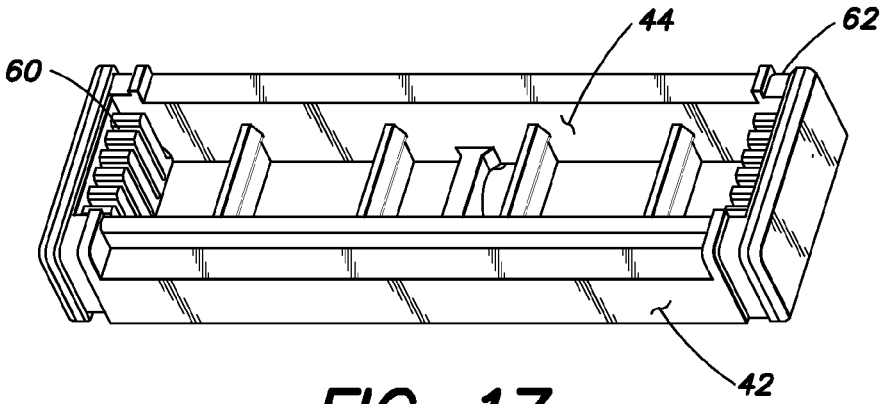
FIG. 17 is an isometric view from the top of the housing of the present invention.

Referring now to FIGS. 15-17, a housing 40 is shown having a front wall 42 having an upper surface 43, a rear wall 44 having an upper surface 45 and two end walls 46 connecting the front and back walls. The housing is provided with one or more rails 50 preferably extending from the front wall to the back wall. The rails have a restraining surface 52 and a lead-in surface 54 to facilitate assembly of each razor blade and support assembly. The housing has one or more slots 60 in each end wall. The housing further has groove 62 extending substantially around the perimeter of each end wall. The housing is preferably a molded thermoplastic and more preferably ABS, in particular the ABS designated HI-10 manufactured by BASF, or any other suitable engineering grade thermoplastic. Although the housing is shown as a one-piece molding, one of skill in the art will realize this could equally be made from two or more moldings permanently joined together.

Figure 18:
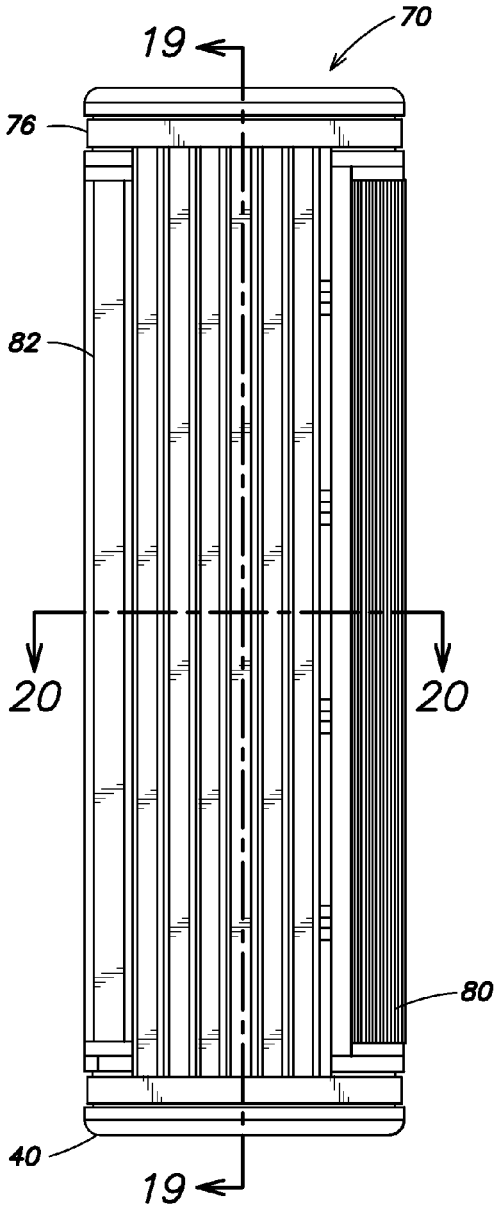
FIG. 18 is a top view of the razor cartridge of the present invention.
Figure 19:
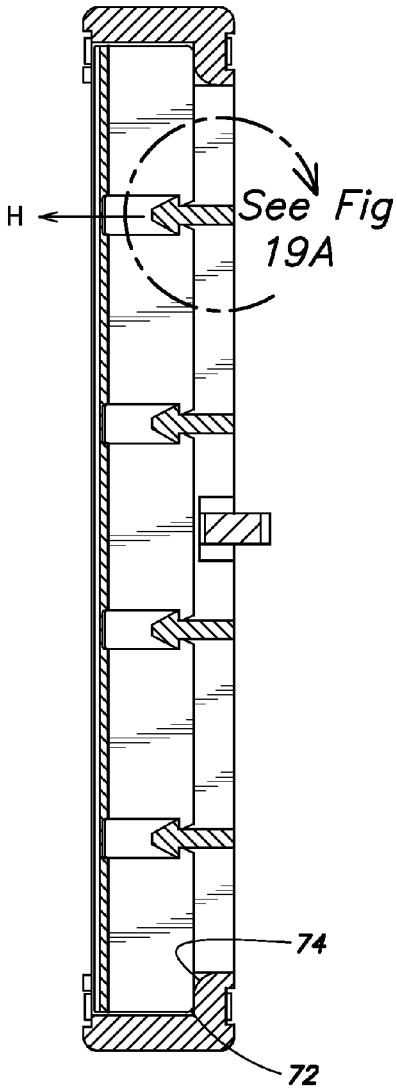
FIG. 19 is a sectional view along line 19-19 of FIG. 18.
Figure 20:
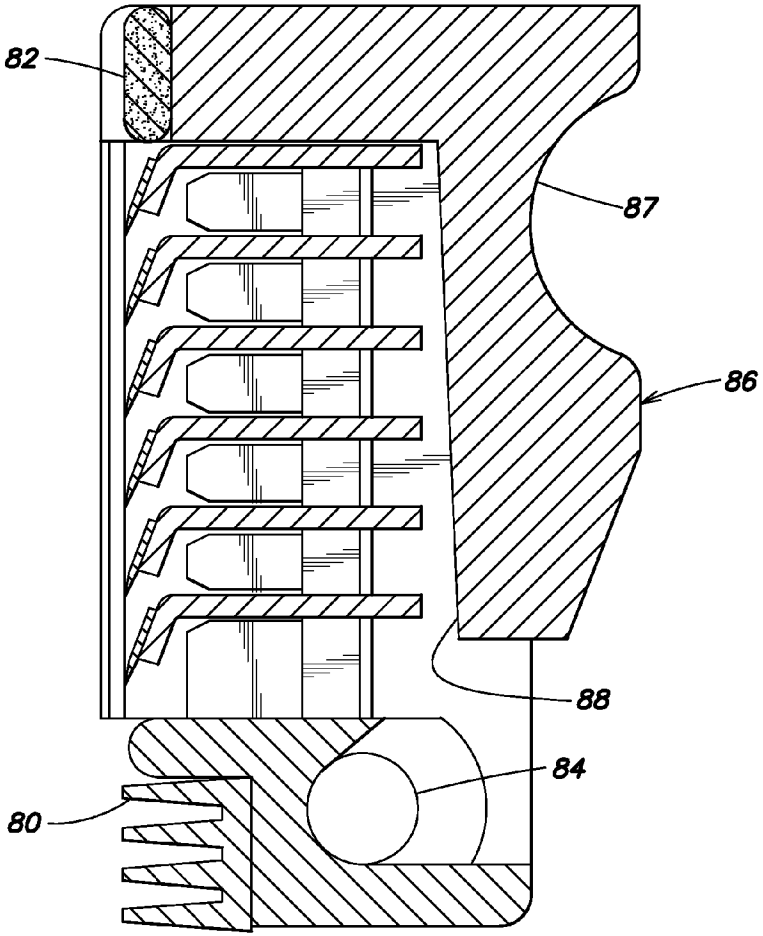
FIG. 20 is a sectional view along line 20-20 of FIG. 18.
Figure 19A:
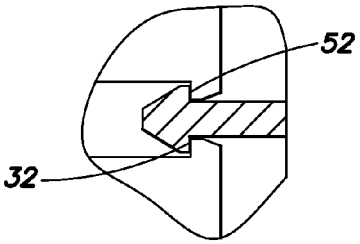
FIG. 19A is a detailed view of FIG. 19.

Referring now to FIGS. 18-20, a razor cartridge 70 is shown comprising a housing 40 and one or more razor blade and support assemblies. The razor blade and support assemblies are shown in their undeflected condition. The razor blade and support assemblies are assembled in the housing with the extreme lengthwise ends of the lower portion of the blade support positioned within opposed pairs of slots 60 in each housing end wall. The housing end wall is provided with a shelf 72 to support the extreme ends of the lower portion of each blade support. The shelf falls away from the blade support in position 74 to ensure the razor blade and support assembly is preferably supported close to its lengthwise ends. As is shown in FIG. 19A, stop surfaces 32 of the blade support are closely spaced from restraining surfaces 52 of the housing rails to restrict the flexural deflection of the razor blade and support assembly in direction H, that is, in a direction out of the housing. Metallic bands 76 positioned within the housing grooves substantially encompass the housing to permanently position each razor blade and support assembly in the housing. The razor cartridge is preferably provided with a flexible, skin stimulating member 80 mounted on the upper surface of the front wall of the housing as is well known in the art. The razor cartridge is also preferably provided with a water leachable shaving aid member 82 mounted on the upper surface of the rear wall of the housing as is well known in the art. The housing is preferably provided with a cylindrical recess 84 for pivotal coupling of a handle to the razor cartridge. The housing has projection 86 having a limit surface 88. The limit surface limits the maximum flexural deflection of each razor blade and support assembly when the lower portion of each blade support abuts the limit surface. As can be seen in this figure, the gap between the lower portion of each blade support and the limit surface is not identical. As a result, differing flexural deflection limits for each razor blade and support assembly may be provided. Preferably the forwardmost razor blade and support assembly is provided with a greater flexural deflection limit than other such assemblies. The forwardmost razor blade and support assembly is the first such assembly to pass any specific point of the surface being shaved during the act of shaving and is generally the assembly closest to the front wall of the housing. The forwardmost razor blade and support assembly will generally provide the greatest contribution to the hair cutting function of the entire razor cartridge during shaving, consequently this assembly is provided with the greatest flexural deflection limit. However, one of skill in the art will understand that the force distribution on each razor blade and support assembly is a result of many factors including: the number of razor blade and support assemblies positioned in the housing; the position of the particular razor blade and support assembly within the housing, and especially relative to any axis for pivotal motion of the razor cartridge and the particular shaving geometry of each razor blade and support assembly. The shaving geometry of each razor blade and support assembly includes values well known in the art as angle, span, sharpness and exposure. One of skill in the art may wish to provide different flexural deflection limits for each razor blade and support assembly to compensate for different force distributions on each razor blade and support assemblies.

The housing projection also has a lower cam surface 87 that engages a return spring member of the handle for pivotally returning to razor cartridge to a neutral position. The execution of a suitable return spring member is well known to one of skill in the art and this element is omitted from the drawings.

Figure 21:
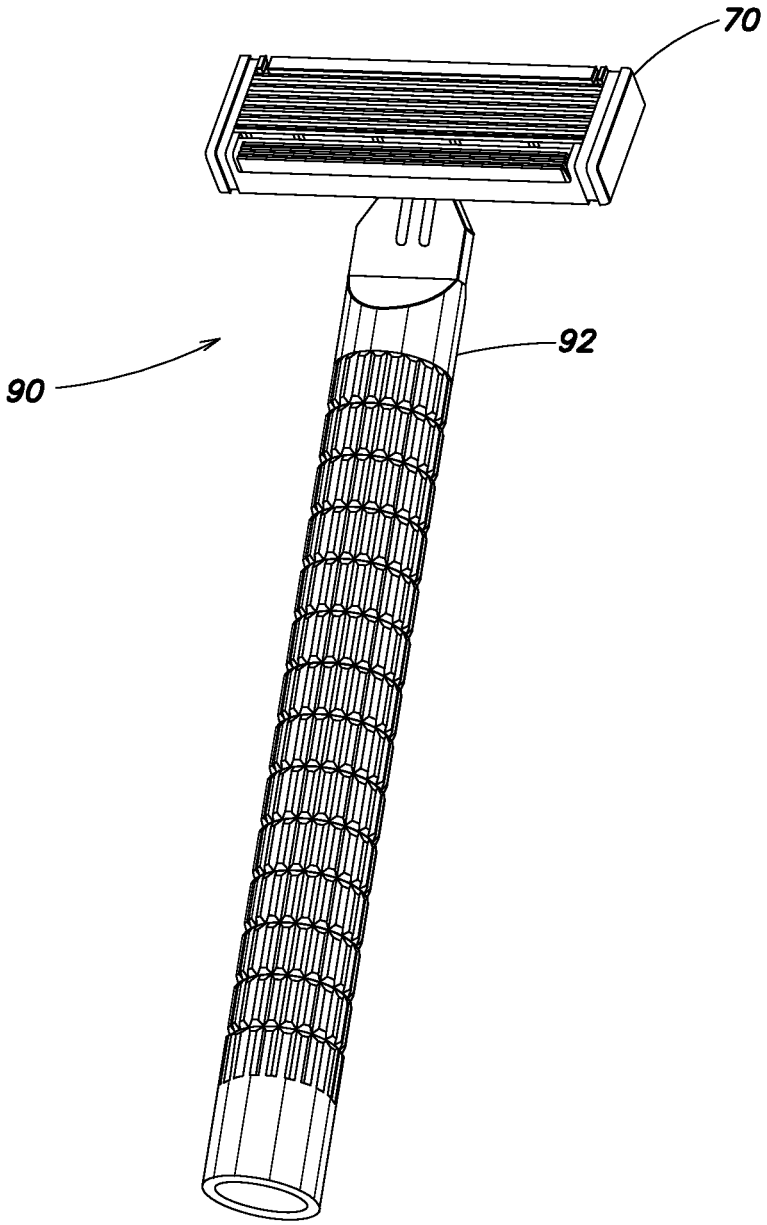
FIG. 21 is an isometric view from the front of the shaving razor of the present invention.

Referring now to FIG. 21, a shaving razor 90 is shown having the razor cartridge as previously described coupled to handle 92.

Figure 7:
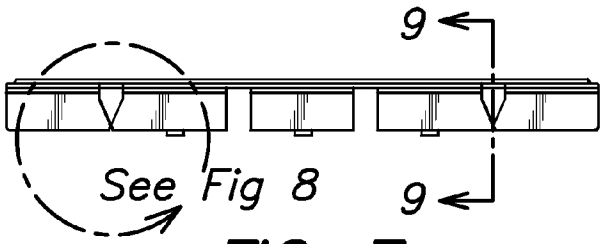
FIG. 7 is a front view of a still further embodiment of the present invention.
Figure 9:
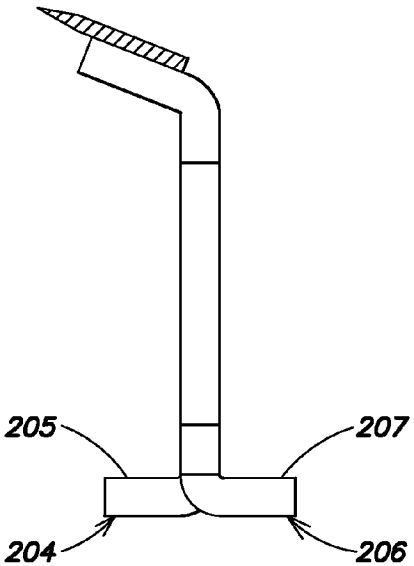
FIG. 9 is a sectional view along line 9-9 of FIG. 7.
Figure 6:
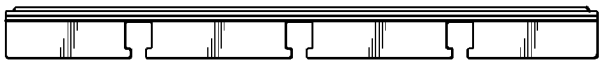
FIG. 6 is a front view of a further embodiment of the present invention.
Figure 8:
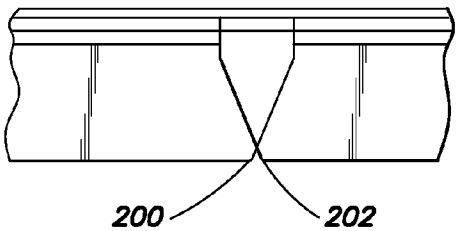
FIG. 8 is detailed front view of area 8 of FIG. 7.

Referring now to FIG. 6-12, alternative embodiments of the razor blade and support assembly are shown. FIG. 6 shows the slots in the lower portion of a single blade support extending within the lower portion only. FIG. 7 shows discrete blade supports spaced apart along the length of the razor blade. FIG. 8 shows an alternative stop surface arrangement wherein a projection 200 on the outer end of one blade support closely abuts the outer end of the adjacent blade support 202. In this example, flexural deflection of the razor blade and support assembly in a direction out of the housing, that is equivalent to vertically up the page in this view, is controlled by the abutment of the projection and adjacent blade support, whereas flexural deflection in the opposite direction is feasible. FIG. 9 shows an alternative stop surface 205 on the top of a tab 204 of the lower portion of a blade support on the same side as the upper portion of the blade support. FIG. 9 shows a further alternative stop surface 207 on the top of a tab 206 of the lower portion of a blade support on the opposite side as the upper portion of the blade support. FIG. 7 shows that various embodiments of stop surface may be simultaneously employed along the length of the razor blade and support assembly.

Figure 10:
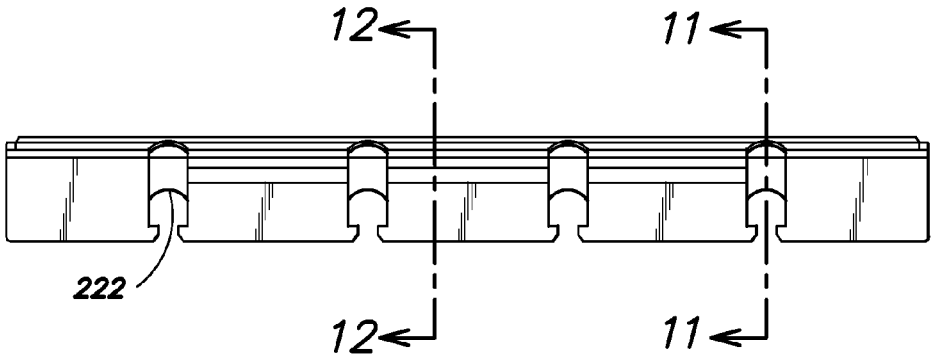
FIG. 10 is front view of a still further embodiment of the present invention.
Figure 11:
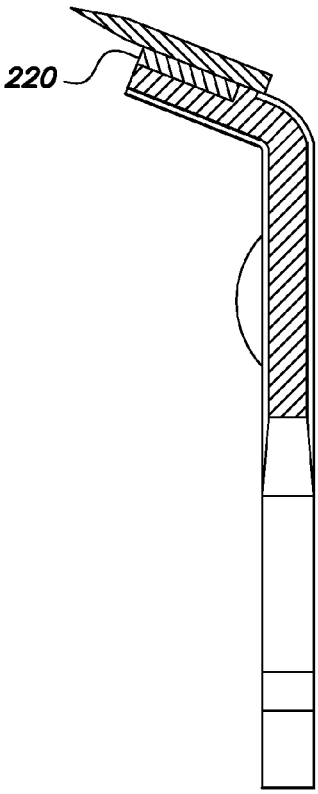
FIG. 11 is a sectional view along line 11-11 of FIG. 10.
Figure 12:
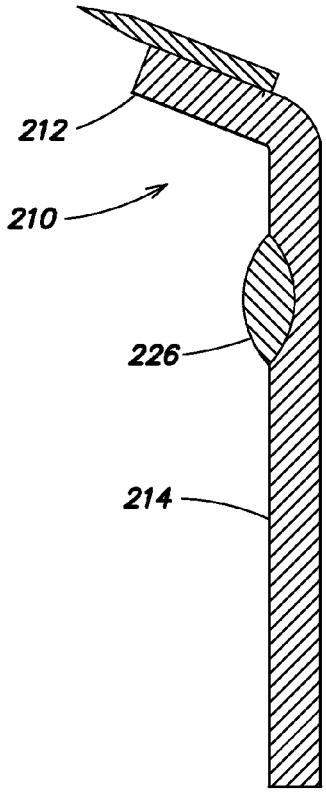
FIG. 12 is a sectional view along line 12-12 of FIG. 10.

FIGS. 10-12 illustrate a further alternative embodiment of the razor blade and support assembly wherein the blade support is a molded thermoplastic and more preferably is two-shot molded. The blade support 210 has an upper portion 212 and a lower portion 214. Two or more blade supports are spaced apart along the length of the razor blade. The blade supports are substantially discrete but may be homogeneously interconnected adjacent to neutral axis of the razor blade and support assembly by interconnect 220. Discrete blade supports may be molded by providing one gate, or injection point, to each, but use of the interconnect permits the use of one gate to mold all the blade supports. More preferably, this embodiment uses a web 222 of a second, more flexible, material that bridges adjacent blade supports. Discrete webs may be molded by providing one gate for each web but a web interconnect 226 permits the use of one gate to mold all of the webs. The blade supports are preferably molded from a high flow, engineering grade thermoplastic such as polyamide and the webs are preferably molded from a highly elastic thermoplastic elastomer (TPE), preferably modified to chemically bond to the polyamide. A suitable polyamide is a polyamide 6.6 manufactured by Du Pont and designated Zytel ST801. This material has a tensile modulus of 2000 MPa. A suitable TPE is manufactured by Kraiburg and designated Thermolast K TC2AAA. This particular TPE has a hardness value of 25 measured on the Shore A scale and an elongation at break of 600%. One of skill in the art will realize that this TPE is highly elastic and has a much lower modulus than the polyamide 6.6.

It is to be understood that the present invention is by no means limited to the particular construction herein disclosed and/or shown in the drawings, but also comprises any modifications or equivalents within the scope of the disclosure.

What is claimed is:

1. A razor cartridge comprising:

a housing having a front wall including a guard at the front of the housing, a rear wall including a cap at the rear of the housing, a blade mounting region between the guard and the cap, two end walls connecting the front wall and the back wall and rail structure in the blade mounting region having a restraining surface;

at least one razor blade and support assembly positioned in the blade mounting region, the razor blade and support assembly comprising a razor blade and a blade support, the blade support having an upper portion and a lower portion, the upper portion of the blade support being attached to a lower surface of the razor blade, and the lower portion of the blade support having a slot and having at least one stop surface adjacent the slot, wherein the slot enables the assembly to flex near the slot;

wherein the stop surface of the blade support is closely spaced from the restraining surface of the rail structure to permit flexural deflection of the razor blade and support assembly in a direction into the housing and to restrict flexural deflection of the razor blade and support assembly in a direction out of the housing.

2. The razor cartridge of claim 1, wherein the rail structure extends from the front wall to the back wall.

3. The razor cartridge of claim 1, wherein the housing further comprises a limit surface.

4. The razor cartridge of claim 3, wherein the limit surface limits the maximum flexural deflection of the razor blade and support assembly in the direction into the housing.

5. The razor cartridge of claim 4, wherein the razor cartridge comprises at least two razor blade and support assemblies.

6. The razor cartridge of claim 5, wherein the forwardmost razor blade and support assembly is provided a greater maximum flexural deflection limit than any other razor blade and support assembly.

7. A razor cartridge comprising:

a housing having a front wall including a guard at the front of the housing, a rear wall including a cap at the rear of the housing, a blade mounting region between the guard and the cap, two end walls connecting the front wall and the back wall and rail structure in the blade mounting region having a restraining surface;

at least one razor blade and support assembly positioned in the blade mounting region, the razor blade and support assembly comprising a razor blade and at least two blade supports, each having an upper portion and a lower portion, the upper portion of each blade support being attached to a lower surface of the razor blade; wherein at least one lower portion of one blade support defines a space along a length of the razor blade from the lower portion of the other blade support, wherein any one blade support has a stop surface adjacent the space and wherein the space enables the assembly to flex;

wherein the stop surface of the blade support is closely spaced from the restraining surface of the rail structure to permit flexural deflection of the razor blade and support assembly in a direction into the housing and to restrict flexural deflection of the razor blade and support assembly in a direction out of the housing.

8. The razor cartridge of claim 7, wherein the rail structure extends from the front wall to the back wall.

9. The razor cartridge of claim 7, wherein the housing further comprises a limit surface.

10. The razor cartridge of claim 9, wherein the limit surface limits the maximum flexural deflection of the razor blade and support assembly in the direction into the housing.

11. The razor cartridge of claim 7, wherein the razor cartridge comprises at least two razor blade and support assemblies.

12. The razor cartridge of claim 11, wherein the forwardmost razor blade and support assembly is provided a greater maximum flexural deflection limit than any other razor blade and support assembly.

* * * * *